US005379481A

United States Patent [19]

DeMars

[11] Patent Number: 5,379,481

[45] Date of Patent: Jan. 10, 1995

[54] COMBINED DUSTPAN AND BROOM

[76] Inventor: Robert A. DeMars, 23221 Ladrillo Ave., Woodland Hills, Calif. 91367

[21] Appl. No.: 15,452

[22] Filed: Jan. 25, 1993

[51] Int. Cl.[6] ..... A47L 13/52

[52] U.S. Cl. ..... 15/257.4; 15/257.2

[58] Field of Search ..... 15/257.2, 147.1, 247, 15/257.1, 257.4, 257.7, 104.8

[56] References Cited

U.S. PATENT DOCUMENTS

| | | | |
|---|---|---|---|
| 573,460 | 12/1896 | Gerow | 15/257.4 |
| 721,365 | 2/1903 | Green | 15/257.4 |
| 2,899,699 | 8/1959 | Caisse | 15/257.4 |

FOREIGN PATENT DOCUMENTS

| | | | |
|---|---|---|---|
| 103632 | 4/1938 | Australia | 15/257.4 |
| 388170 | of 1909 | France | 15/257.4 |
| 1039125 | 10/1953 | France | 15/257.4 |
| 1332021 | 6/1963 | France | 15/257.4 |

*Primary Examiner*—David A. Scherbel
*Assistant Examiner*—Tony G. Soohoo
*Attorney, Agent, or Firm*—Jack C. Munro

[57] ABSTRACT

A combined dustpan and broom wherein the dustpan is movable between a usage position and a stowage position. When in the stowage position, a broom is to be stowable in conjunction with the dustpan. A handle is connected to the dustpan by a U-shaped connector with the legs of the connector being offset so that when the broom is connected with the dustpan, movement of the dustpan from a stowage position to a usage position is prevented.

4 Claims, 1 Drawing Sheet

COMBINED DUSTPAN AND BROOM

BACKGROUND OF THE INVENTION

1. Field of the Invention

The field of this invention relates to appliances to facilitate cleaning of floors within homes and businesses and more particularly to a combined dustpan and broom that facilitates storage when not in use and which facilitates the usage of the broom and dustpan.

2. Description of Prior Art

Brooms have long been known. Dustpans have long been known. It has also long been known to combine a broom and a dustpan into a single unit and locate the broom and dustpan together during the time that the broom and dustpan are not being used. However, prior to the present invention it is believed that there has not been known any combined broom and dustpan where the dustpan is prevented from being moved from a stowage position to a usage position when the dustpan is combined with the broom and located in the stowage position.

SUMMARY OF THE INVENTION

One of the primary objectives of the present invention is to combine a broom and dustpan that will prevent the dustpan from being accidentally moved from its stowage position when the broom is combined with the dustpan.

An elongated handle is attached to a U-shaped connector with the legs of the connector extending outwardly. The outer end of the legs of the connector are pivotally connected to a dustpan in the form of an open top container. The point of connection of the legs to the dustpan is such that when the dustpan is removed from a supportive surface, such as a floor, the open top of the dustpan will always be pivoted to the uppermost position preventing spilling of the contents. The dustpan includes a broom head receiving compartment which is to engage with the head of the broom when in the stowage position. When the head of the broom is located within the broom head receiving compartment and the dustpan is in its stowage position, the apex section is located interiorly of the broom head thereby obtaining a locking arrangement preventing accidental movement of the dustpan from the stowage position to the usage position.

DETAILED DESCRIPTION OF THE SHOWN EMBODIMENT

Figure 2:
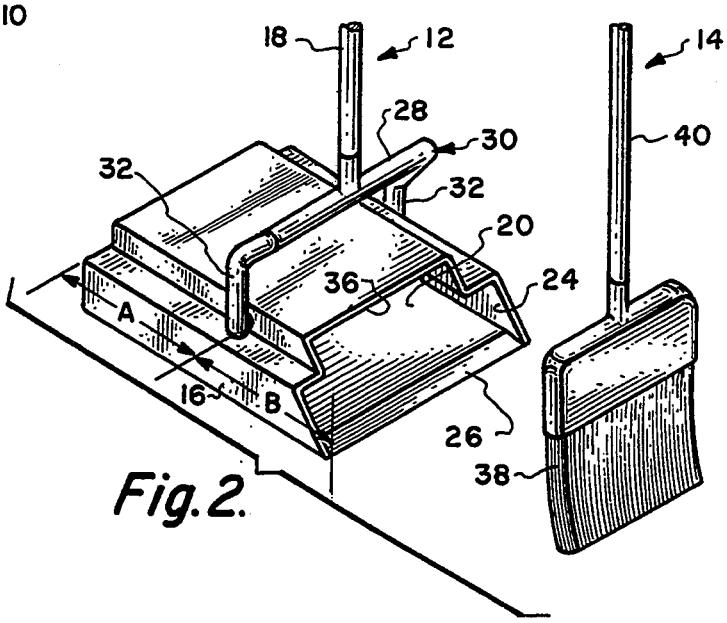
FIG. 2 is an isometric view showing the broom disengaged from the dustpan and in the usage position with the broom spaced from the dustpan.
Figure 3:
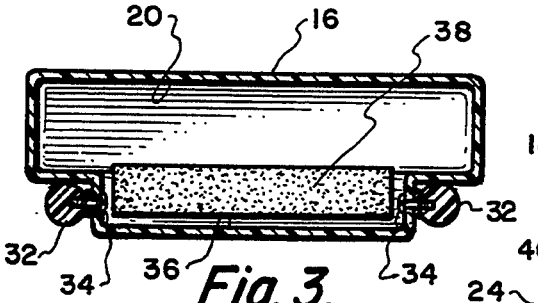
FIG. 3 is a transverse cross-sectional view through the combined dustpan and broom of the present invention taken along line 3—3 of FIG. 1.
Figure 5:
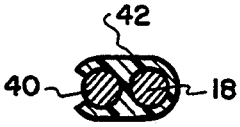
FIG. 5 is a cross-sectional view through the handle latching arrangement utilized in conjunction with the combined dustpan and broom of the present invention taken along line 5—5 of FIG. 1.
Figure 4:
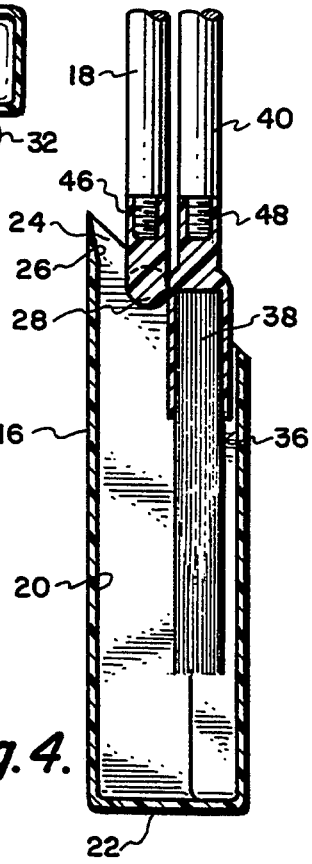
FIG. 4 is a longitudinal cross-sectional view through the combined broom and dustpan of the present invention taken along line 4—4 of FIG. 1.

Referring particularly to the drawing, there is shown the combined dustpan and broom 10 of the present invention which is composed generally of a dustpan unit 12 and a broom 14. The dustpan unit 12 includes a dustpan 16 and a handle 18. The dustpan 16 is basically a rectangular configuration having an internal chamber 20. The dustpan 16 has a closed bottom 22 and an open top edge 24. Associated with the open top edge 24 is an inclined ramp 26. This inclined ramp 26 is to be positioned directly adjacent the floor or other surface from which dust and debris is to be removed. This position of the inclined surface 26 is depicted within FIG. 2 of the drawing.

Figure 1:
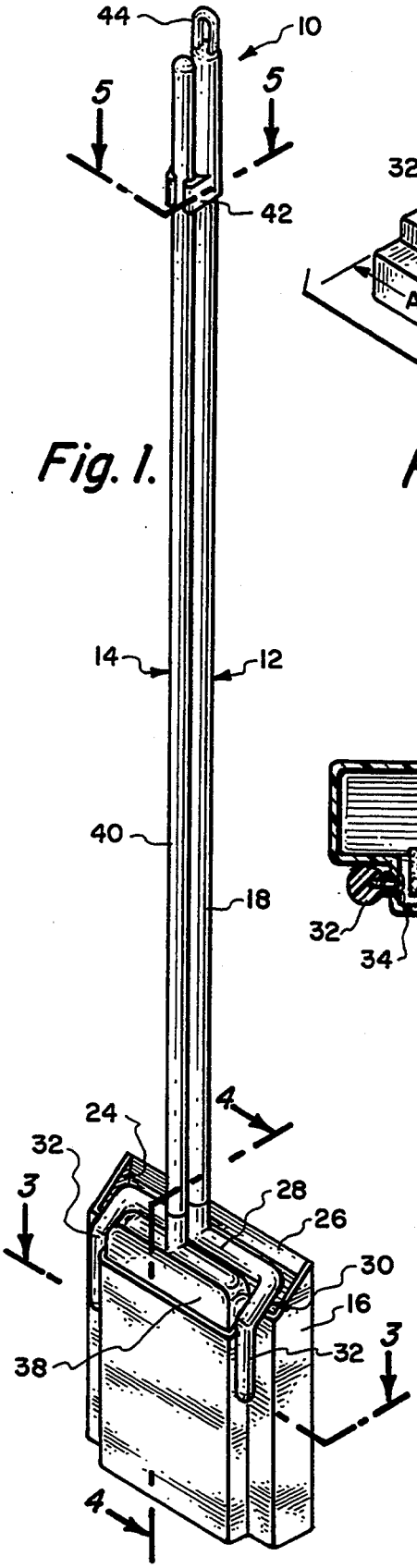
FIG. 1 is a front isometric view of the combined broom and dustpan of the present invention showing the broom and dustpan in the stowage position.

The handle 18 is fixedly connected at the longitudinal center point of the apex portion 28 of the U-shaped connector 30. Integrally connected at each end of the apex section 28 is a leg 32. The legs 32 are basically identical but are mirror images of each other. It is to be noted that the upper portion of each leg 32 is offset at approximately a forty-five degree angle relative to the lower portion of each leg 32. The outer end of the legs 32 are pivotally connected by means of conventional bolt fasteners 34 to the dustpan 16. The point of connection established by bolts 34 is distance B from the highest point of the top edge 24 and distance A from the bottom 22. Distance B is shorter than distance A. The reason for this is that with the dustpan 16 in the position shown in FIG. 2 and a lifting upward motion as applied to the handle 18, the center of gravity of the dustpan 16 relative to the handle 18 will automatically cause the dustpan 16 to pivot ninety degrees to assume the position shown in FIG. 1. This locates the apex section 28 within the confines of the open top edge 24.

Dustpan 16 includes a broom head receiving compartment 36 which is open to the compartment 20. The size of the broom head receiving compartment 36 is selected to facilitate location of the broom head 38 within the compartment 36. When the broom head 38 is in the compartment 26, the handle 40 is located side-by-side with handle 18 with a latching device 42 being used to secure handle 40 to handle 18. Handle 40 can be readily disengaged from handle 18 when such is desired so as to affect removal of the broom head 38 from the broom head receiving compartment 36 which will then permit the dustpan 12 to be moved to the usage position shown in FIG. 2. In this position, the broom 14 can be utilized to push dust, dirt and other debris within the internal chamber 20. The collected debris within internal chamber 20 can then be discarded in an appropriate collecting container and the broom head then reinserted within the broom head receiving compartment when apex section 28 is positioned within the open top edge 24.

Fixedly secured to the upper free end of the handle 18 is a hanging bracket 44. The bracket 44 facilitates locating of the combined dustpan and broom 10 of this invention on an exteriorly mounted structure such as an nail or hanger that is to be fixedly mounted within a wall (not shown).

The handle 18 may be integrally connected to the U-shaped connector or the U-shaped connector can be made separate with the connection being established to the handle 18 by means of a threaded connection 46. A similar threaded connection 48 may be utilized between the broom head 38 and the handle 40.

What is claimed is:

1. A combined dustpan and broom comprising:

a dustpan having an internal chamber, an open top edge, and a closed bottom, a portion of said top edge having an inclined ramp to facilitate the entry of dust and debris into said internal chamber, said dustpan having a separate broom head receiving compartment which is open to said internal chamber;

a first handle, a U-shaped connector having an apex section from which extends a pair of parallel legs, said apex section being fixed to said first handle, said parallel legs having outer ends which are pivotally connected to said dustpan at points which are closer to said open top edge than said closed bottom, each of said parallel legs being offset from said apex section to said outer end such that said dustpan is movable relative to said first handle between a usage position and stowage position, said stowage position locates said apex section across said open top edge, said usage position locates said dustpan relative to said first handle approximately ninety degrees displaced from its position in said stowage position; and a broom having a broom head attached to a second handle, said broom head located in said broom head receiving compartment when said dustpan is in said stowage position such that said apex is located between said broom head and said inclined ramp to prevent movement of said dustpan to said usage position and having said second handle being in juxtaposition to said first handle.

2. The combined dustpan and broom as defined in claim 1 wherein:

said pair of parallel legs being of the same length.

3. The combined dustpan and broom as defined in claim 2 wherein:

said first handle being connected at the longitudinal center of the length of said apex section.

4. The combined dustpan and broom as defined in claim 3 wherein:

a latching means mounted on said first handle, said second handle to engage with said latching means when said broom head is located within said broom head receiving compartment and said dustpan is in said stowage position.

* * * * *